United States Patent [19]

Beck et al.

[11] Patent Number: 4,952,268

[45] Date of Patent: Aug. 28, 1990

[54] LAMINATED WATERPROOFING MATERIAL CONTAINING ASPHALT AND METHOD OF MAKING IT

[75] Inventors: Martin H. Beck; Louis D. Tacito, both of Merrimack, N.H.; Warren Arseneau, Burlington, Canada; Robert J. Booth, Dalkeith, Canada; Khalid Jasim, Beaconsfield, Canada

[73] Assignee: Devtech Labs, Inc., Amherst, N.H.

[21] Appl. No.: 346,239

[22] Filed: May 2, 1989

[51] Int. Cl.[5] ..... B32B 31/12; B32B 31/20; B32B 11/04

[52] U.S. Cl. ..... 156/295; 156/71; 156/337; 428/134; 428/139; 428/140; 428/220; 428/489

[58] Field of Search ..... 156/71, 252, 295, 303.1, 156/337; 428/134, 139, 140, 220, 489

[56] References Cited

U.S. PATENT DOCUMENTS

| | | | |
|---|---|---|---|
| 2,771,387 | 11/1956 | Kleist et al. . | |
| 3,511,729 | 5/1970 | Williams . | |
| 3,581,631 | 6/1971 | Rozendaal et al. . | |
| 3,650,879 | 3/1972 | Munting . | |
| 3,745,052 | 7/1973 | Higgins . | |
| 3,753,938 | 8/1973 | Edwards . | |
| 3,900,102 | 8/1975 | Hurst . | |
| 3,962,137 | 6/1976 | Taylor . | |
| 3,967,032 | 6/1976 | Plotz et al. | 156/337 X |
| 3,996,401 | 12/1976 | Van Nechel . | |
| 4,115,617 | 9/1978 | Mitsuishi et al. . | |
| 4,242,396 | 12/1980 | Wilson et al. . | |
| 4,343,847 | 8/1982 | Meynard . | |
| 4,473,610 | 9/1984 | Davis . | |
| 4,518,658 | 5/1984 | Baravian et al. . | |
| 4,521,478 | 6/1985 | Hageman | 156/71 X |
| 4,588,458 | 5/1986 | Previsani | 156/71 |
| 4,662,972 | 5/1987 | Thompson . | |

FOREIGN PATENT DOCUMENTS

| | | |
|---|---|---|
| 969727 | 6/1975 | Canada . |
| 1017885 | 9/1977 | Canada . |
| 1153942 | 9/1983 | Canada . |
| 1173214 | 8/1984 | Canada . |
| 1208870 | 8/1986 | Canada . |

*Primary Examiner*—Robert A. Dawson
*Attorney, Agent, or Firm*—Davis, Bujold & Streck

[57] ABSTRACT

The present invention relates to an apparatus and method and uses a thin, yet strong plastic film as the intermediate layer for the waterproofing material and the film has a plurality of perforations therein. The film is highly resistant to crack propagation, and acts as a barrier to crack propagation between adjacent asphalt layers, thus providing superior protection from the elements. The asphalt layers are interconnected with each other through the perforations in the polyester support layer. Because of the strength of the polyester film, only a very thin layer of polyester is necessary and this results in a substantial cost savings. As an alternative to coating, it is possible to extrude or laminate the asphalt onto the PET film. Also a layer of asphalt may be applied only to one side of said film and extruded through the perforations with heads on the columns so formed to attach the asphalt to the film.

28 Claims, 3 Drawing Sheets

LAMINATED WATERPROOFING MATERIAL CONTAINING ASPHALT AND METHOD OF MAKING IT

FIELD OF THE INVENTION

This invention relates to a laminated air/vapor barrier/waterproofing material and a method of manufacture thereof, and more particularly to an improved roofing shingle which employs an internal perforated plastic film support of high flexibility and strength between the exterior asphalt layers and a method of manufacturing the same using a high line production speed made possible by the film support.

BACKGROUND OF THE INVENTION

Modern roofing materials generally represent a compromise between various performance characteristics which are highly desirable, the economics of the manufacture of the shingle itself, and limitations imposed on the roof construction process by the shingle. Most prefabricated shingles have a three or four layer structure consisting of a first asphalt layer; an intermediate support layer, such as paper, fiberglass or polyester fibers in the form of a mat or yarn; and a second, thicker asphalt layer in which is embedded weather resistant minerals such as slate or rock granules. The physical characteristics of the shingle itself vary widely depending upon the softening and the fluid ranges of the asphalt, the nature of the intermediate support, and the nature, amount and size of mineral matter contained in the upper layer. The interplay of these characteristics of the basic materials from which the shingle is constructed affect the manufacturing process and its economics.

Waterproofing materials, including shingles, are most often manufactured by a continuous manufacturing process, with the last step in the process being slicing the product as it emerges from the line into individual shingles, or convenient lengths for individual rolls. The intermediate support material serves as the basic moving framework during the manufacturing process, with hot, molten asphalt being applied to both sides thereof, and, subsequently, the weather-resistant mineral being embedded into the upper layer of hot asphalt. The moving asphalt-laden support material passes through various calendars or nip rolls to adjust the thickness of the asphalt layers and to apply pressure to embed the weather resistant mineral material. A cooling stage follows in the production line before slicing, stacking and packaging. A critical factor during manufacture is the line speed which, to a great extent, depends upon the mechanical strength of the intermediate layer support material.

The lowest cost intermediate layer support material presently used is paper. However, paper is mechanically weak and tears easily when subjected to moderate stress or elongation. In addition, paper is very notch sensitive. The paper web will tear very easily if one edge is ripped or torn and, therefore, a great deal of care must be exercised in handling the paper rolls. Thus, in the usual manufacturing process, the line speed is relatively slow when paper is used compared to stronger materials. In addition, asphalt does not adhere well to most paper supports. Also, paper is moisture sensitive, so it is usually necessary to impregnate a saturant, which is a "neat" unfilled asphalt, in the paper to get adequate adhesion and moisture resistance. Saturants are costly, offsetting the advantage due to the cheapness of the paper. Volatile components of the saturant may require expensive measures to prevent health hazards during the manufacturing process, and they may result in objectionable odor in the finished product. When subjected to cold weather, the paper layer becomes brittle as does the cold-hardened asphalt layers. If the shingle cracks due to some environmental stress, the crack may propagate from one asphalt layer, through the paper, and into the other layers, allowing water penetration.

An intermediate layer of glass fibers has some advantages over a paper layer, both in terms of shingle characteristics and the process of manufacture. However, precautions must be taken on the coating line due to the health hazard to humans which is presented by the irritating glass fibers. Shingles made with glass fibers are very brittle and tear easily, particulary in cold weather. Under these conditions, an errant hammer blow during installation of a roof could crack the shingle. Therefore, they are difficult to apply to a roof in a northern climate except during the warmer months of the year.

Fibers made from plastic materials, such as polyesters, have been used as the intermediate layer material for shingles and other roofing materials. The brittleness and low tear strength of glass and the weakness and moisture sensitivity of paper are avoided by use of these materials. However, these synthetic fibers are very expensive. In addition, these materials are subject to elongation when subjected to the stress of running through the manufacturing line and, therefore, line speeds must be reduced and production output decreased.

The use of an intermediate layer with perforations is disclosed in U.S. Pat. No. 4,565,724, where the material is fiberglass with holes in the range 50–110 mm (2–4.3 inches), and the open area amounts to 8%–14% of the lateral area of the fiber glass mat. The material was not for use in the manufacture of preformed roofing materials, as in the present invention, but rather it was intended for use in the in situ construction of a built-up roof. The contemplated in situ construction would employ a torch to melt an upper, modified bitumen layer which would then adhere to the substratum and the other layers through the large holes in the fiberglass mat. Such products are termed "button" base sheets or venting base sheets and are well known, especially in Europe.

U.S. Pat. No. 4,567,079 discloses an intermediate layer of organic, fiberglass or asbestos felt with holes, in one margin only, which comprise 1/5 to ½ of the area of the layer. The preferred range of diameters for the holes is ½ to ¾ inch. The anticipated use of the material is again an in situ built-up construction with hot mopping of molten asphalt on the margins to obtain adherence through the perforations. Use in the construction of preformed waterproofing materials, such as shingles ,is not contemplated.

SUMMARY OF THE INVENTION

Accordingly, it is an object of the present invention to overcome the above-mentioned difficulties to a greater extent than previously possible in an economical and commercially feasible manner.

Another object of the present invention is to provide an intermediate layer material which is mechanically strong to resist tearing when stressed, both environmentally in the finished waterproofing material and during the waterproofing material manufacturing process so that production can be accomplished at high speed.

A further object of the present invention is to provide an intermediate layer material that remains flexible, as well as strong, over a wide range of temperatures, so that the waterproofing material may be used in roof construction during cold weather and the finished roof will provide superior protection when stressed environmentally.

Another object of the present invention is to avoid the necessity of using a saturant or adhesives to bond the asphalt layers to the intermediate support layer.

A still further object is to minimize the operations occurring during a manufacturing line run which are labor intensive, such as splicing successive rolls of the intermediate support layer material.

Still another object of the present invention is to minimize the cost of intermediate layer material by recycling the material removed from the plastic film when the film is perforated.

Glass mats and non-woven PET mats use binders to hold the mats together. Therefore, the final object of the present invention is to eliminate the use of resin binders in the manufacture of roofing materials, which can lose strength during manufacture and aging.

The present invention uses a thin, yet strong plastic, preferably polyester, film as the intermediate layer for the waterproofing material and it has a plurality of perforations therein. The strength of the polyester film permits the waterproofing material production line to be run at high speeds with consequently high production rates and low down time. The use of polyester film results in waterproofing materials with superior flexibility, even in cold weather. The film layer also is highly resistant to crack propagation, and acts as a barrier to crack propagation between asphalt layers, thus providing superior protection from the elements. The past designs of waterproofing materials have tried to achieve bonding of the asphalt layers to the intermediate support layer, thereby maintaining the integrity of the entire composite structure. Surprisingly, the present invention achieves this goal by allowing the asphalt layers to interconnect each other directly through the perforations in the polyester support layer. This obviates the need for saturants or adhesives of any kind. Because of the strength of the polyester film, only a very thin layer of polyester is necessary and this results in a substantial cost savings. Moreover, the material removed in making the perforations in the polyester film can be recycled, and, in fact, the film can be made entirely from recycled materials. As an alternative to coating, it is possible to extrude or laminate the asphalt onto the PET film. Even lighter weights are achieved with this method. The waterproofing material is a roofing material in a preferred form.

According to the invention there is provided a laminated material comprising:

a layer of plastic film having a plurality of perforations spaced apart therein;

a first layer of asphalt on one side of said the plastic film; and a second layer of asphalt on the other side thereof;

wherein said first and second layers of asphalt are integrally joined to one another through the perforations in the plastic film thereby resulting a unitary laminated structure.

Also according to the invention there is provided a waterproofing material comprising;

a biaxially oriented polyester film having a plurality of perforations therein;

a first layer of asphalt on one side of said polyester film; and a second layer of asphalt which is thicker than said first layer of asphalt and having embedded therein a weather resistant material amounting to a substantial portion of the composition of said second layer;

wherein a plurality of columns of asphalt extend through said perforations in said polyester film to interconnect and integrally joining the two layers of asphalt together, said columns of asphalt having a cross sectional area comprising a substantial portion of the lateral area of said waterproofing material.

Also according to the invention there is provided a method of manufacturing a laminated material, comprising the steps of:

(a) unrolling a desired length of plastic film having a plurality of perforations therein;

(b) applying molten asphalt to both surfaces of the unrolled plastic film;

(c) squeezing said plastic film, with the molten asphalt on both surfaces thereof, so that the asphalt is forced through the perforations in said plastic film to integrally join both asphalt layers together; and (d) cooling said laminated material.

Also according to the invention there is provided a method of manufacturing waterproofing material, comprising the steps of:

(a) unrolling a continuous polyester film having a plurality of perforations therein;

(b) applying molten asphalt to both surfaces of the unrolled polyester film to form layers thereon;

(c) squeezing said polyester film, with the molten asphalt on both surfaces thereof, so that the asphalt is forced through the perforations in said polyester film to integrally join both asphalt layers together;

(d) depositing and impregnating a weather resistant material in at least one asphalt surface; and (e) cooling said waterproofing material.

Also according to the invention there is provided a laminated material comprising:

a layer of plastic film having a plurality of spaced apart perforations therein; and a layer of asphalt on one side of said the plastic film;

wherein said layer of asphalt and said plastic film are joined to one another by columns of said asphalt extending through the perforations in the plastic film with the ends of the columns flattened to form column heads attaching the asphalt to the film.

Also according to the invention there is provided a method of manufacturing a laminated material, comprising the steps of:

(a) providing a strip of plastic film having a plurality of perforations therein;

(b) applying extrudable asphalt to a surface of the plastic film;

(c) squeezing said plastic film, with the asphalt on surfaces thereof, so that the asphalt is extruded through the perforations in said plastic film and spreading the columns on the surface of the film remote from the applied asphalt to form heads to intimately join the asphalt layer and the film together; and (d) cooling said laminated material.

Also according to the invention there is provided a method of manufacturing a laminated material, comprising the steps of:

(a) providing a strip of plastic film having a plurality of perforations therein;

(b) providing a strip of asphalt on both surfaces of the plastic film;

film, with the asphalt on both surfaces thereof, so that the asphalt is extruded through the perforations in said plastic film to integrally join both asphalt layers together; and (d) cooling said laminated material.

BRIEF DESCRIPTION OF THE DRAWINGS

A waterproofing material in the form of a roofing material and a method of manufacturing it will now be described, by way of example, with reference to the accompanying drawings, in which.

DETAILED DESCRIPTION OF THE INVENTION

A central feature of the present invention is the use of a perforated plastic film, such as polyester, as the intermediate support material in the manufacture of waterproofing materials such as roofing shingles. The purpose of the film is to provide strength and reinforcement for the waterproofing material, and to function as a transport media which is run through a coating line during the manufacturing process and which accepts hot, molten asphalt on both sides before a weather resistant mineral material is embedded and admixed into at least one asphalt surface. A preferred embodiment employs a heat set, biaxially oriented film of polyethylene terephthalate (PET) which is from about 0.003 to about 0.012 inches thick. The PET may be recycled, either wholely or in part, and it is contemplated that the PET removed during the perforation process will be recycled to minimize the costs of raw materials. The recycled PET typically has a stretch ratio of about 2.5 to about 5.0 in each of the biaxial directions, and the PET has a density range from about 1.35 g/cc to about 1.45 g/cc.

Figure 1:
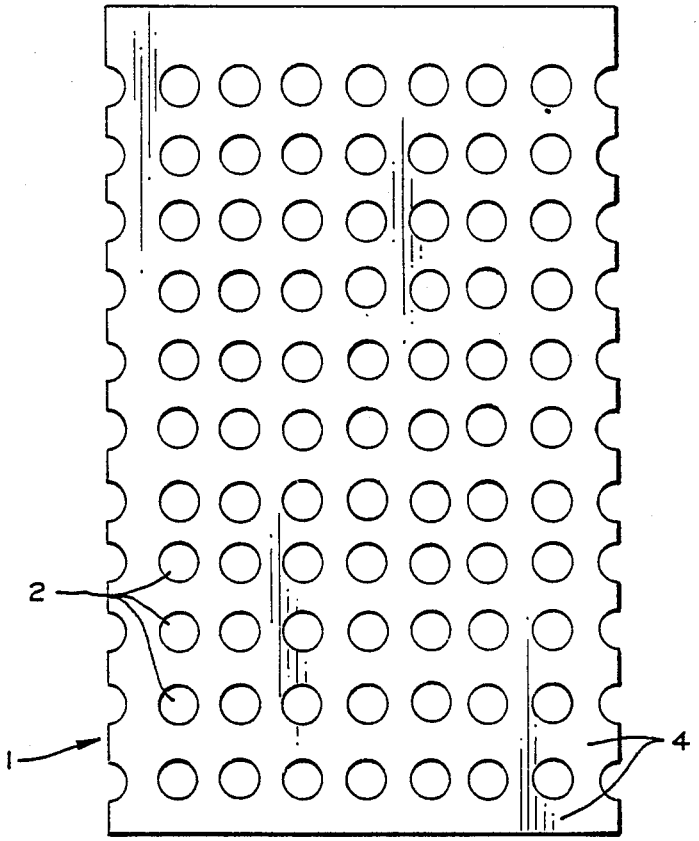
FIG. 1 shows a top plan view of a polyester intermediate material with a plurality of uniform perforations in both biaxial directions.

FIG. 1 shows a plan view of the polyester intermediate layer material 1 with a uniform pattern of perforations 2 in both biaxial directions. The perforations are circular and have a diameter of from about 0.04 to about 0.20 inches comprising from about 20% to about 70% (preferably 30% to 60%) of the total surface area.

Figure 2:
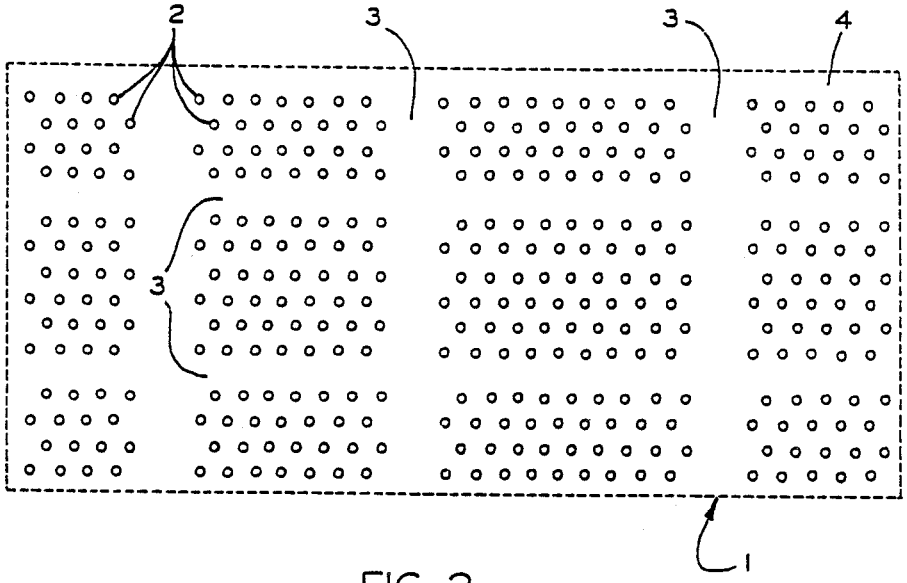
FIG. 2 shows a top plan view of a polyester intermediate material with a plurality of perforations in a pattern that results in non-perforated reinforcing strips in both biaxial directions.

FIG. 2. shows a top plan view of a polyester film having an alternative arrangement for the perforations Z. In this embodiment, there are unperforated areas which serve as reinforcing strips 3 and edge borders 4 of from about 0.25 to about 0.625 inches wide.

Figure 3:
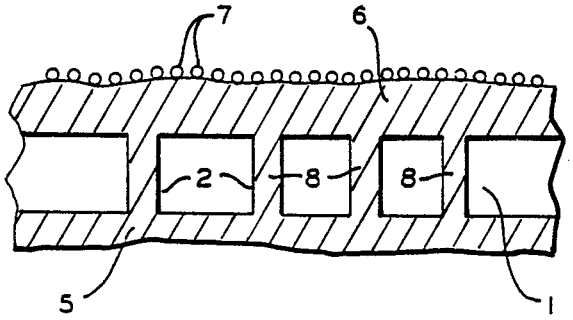
FIG. 3. shows a cross sectional view through a finished roofing product, made according to the present invention, showing the interfaces of the asphalt layers and the intermediate layer.

FIG. 3 shows a cross-section through a finished roofing material. The polyester film 1 is position between a lower layer of asphalt 5 and an upper, thicker layer of asphalt 6, which has mineral material 7 embedded in it. The holes 2 in the polyester film are filled with columns of asphalt 8 which allow the two layers to integrally join one another.

It has been found that asphalt bonds better to itself than to any of the usual intermediate support materials. The holes in the polyester film allow a channel for the asphalt on one side of the film to interconnect with the asphalt on the other side. The usual prior art methods bond the asphalt to the intermediate support material, by either adhesives or saturants, or produce a physical entanglement with the individual fibers of a mat or yarn. The present invention does neither. The holes in the film allow the asphalt on one side of the film to flow through the perforations and integrally join with the asphalt layer on the other side. The joined asphalt columns act as numerous fingers to interlock one layer of the asphalt to the other layer. In turn, the polyester film becomes sandwiched between the two asphalt layers. In addition, there may be some minor adhesion of the asphalt to the polyester film. The pattern and size of the holes in the film are critical for maximizing the adhesion of the asphalt layers. If there are too few holes the adhesion will be minimal, and the structure will fall apart. If the holes are too small, asphalt does not flow through them during manufacture and the layers are not joined to one another. If the holes are too large, the columns of asphalt simply fall out during manufacture and there is no interconnection between the layers. If too great a percentage of the area of the polyester film is removed to form holes, the strength of the film is sacrificed and may fail during manufacture.

The perforations in the polyester film may also be of many different shapes. For example, if a roofing manufacturing line is run at high speed, or if very thin film is used, the film may stretch during production. This may cause some distortion in the shape of the perforations. Such distortions may be compensated for by making the initial perforations in a shape that will be distorted into the desired final shape during production.

In the embodiment shown in FIG. !, the perforations 2 are uniform in both biaxial directions and extend to the edges of the intermediate layer.

In the embodiment shown in FIG. 2, reinforcing strips 3, which do not have perforations, are provided in both biaxial directions. It has been found that holes or partial holes at or near the film edges have a great tendency for initiating tears in the film when stressed. Therefore, the borders 4 of the film in this embodiment are left unperforated. It has also been found that rough edged holes initiate tears and should be avoided.

Figure 6:
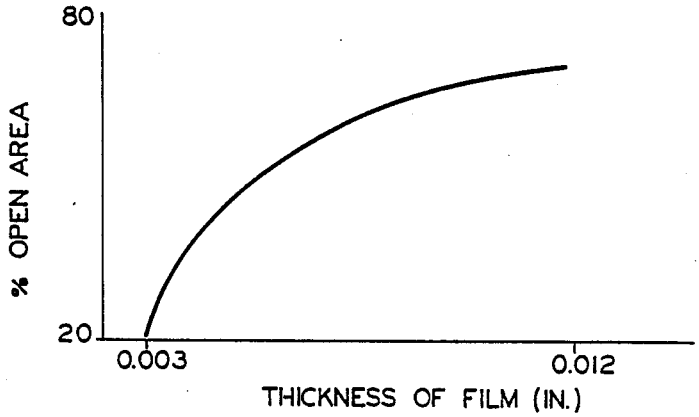
FIG. 6 is a graph showing the relationship of the per cent open area versus the film thickness.

Extrapolations from test results indicate that the effects of variations in the hole size the number of holes, and film thickness (related to strength) interact to produce a preferred curve (shown in FIG. 6) of film thickness to open area for roofing shingles.

Basically, to achieve minimum performance criteria, for example, a high speed run through the coating line without any breaks, a thicker film with more open area will perform in similar fashion to a thinner film with less open area. All performance criteria being substantially equal between the various sheets, the thinner sheet is preferred. First, with less open area the risk of tears is reduced. Less polyester material is removed in the perforation process, there is less of the material to recycle, less effort to create holes, and less registration of hole making. Other factors are that the thinner the film the greater the linear footage per roll and this lowers the raw material costs. In addition, the labor costs on the coating line for changing rolls, splicing them together, etc., are reduced.

In a preferred embodiment, PET film with an open area of from about 20% to about 70% and a corresponding thicknesses of from about 0.003 inch to about 0.012 inch is used in a coating line where the asphalt is applied at a temperature in the range from about 325° to about 425° F., with the limestone fill in the amount of about 40–70% of the asphalt. In some cases, a lesser amount of mineral granules may be used, but in most cases the mineral stabilizer/filler should amount to at least 20% of the finished roofing material.

Figure 4:
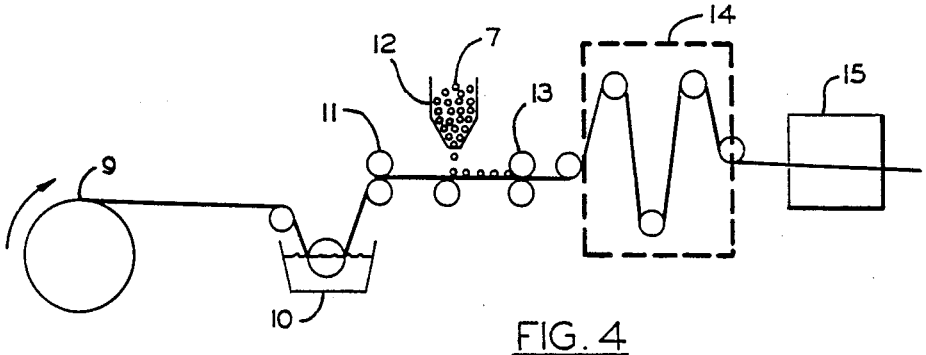
FIG. 4 shows a production line used for the manufacture of the roofing materials.

FIG. 4. shows the coating line for one method of manufacturing roofing materials according to the present invention, where the moving matrix in the line is the perforated PET film 9. Asphalt is applied to the PET film in the asphalt coating box 10 before passing through calendar or nip rolls 11 which adjust the thickness of the asphalt layers and apply pressure to force the molten asphalt through the perforations in the PET film to form the columns 8 of asphalt that join the asphalt layers together. Granules 7 are applied to the upper asphalt layer 6 by gravity feed 12 before passing through another set of calendar rolls 13 which embed the granular particles into the asphalt. After passing through a cooling area 14, the finished roofing material arrives at the end of the line 15 where it is slit, stacked and packaged. Using the above-mentioned ranges, commercial line production speeds from 100–450 feet per minute may be achieved.

Figure 5:
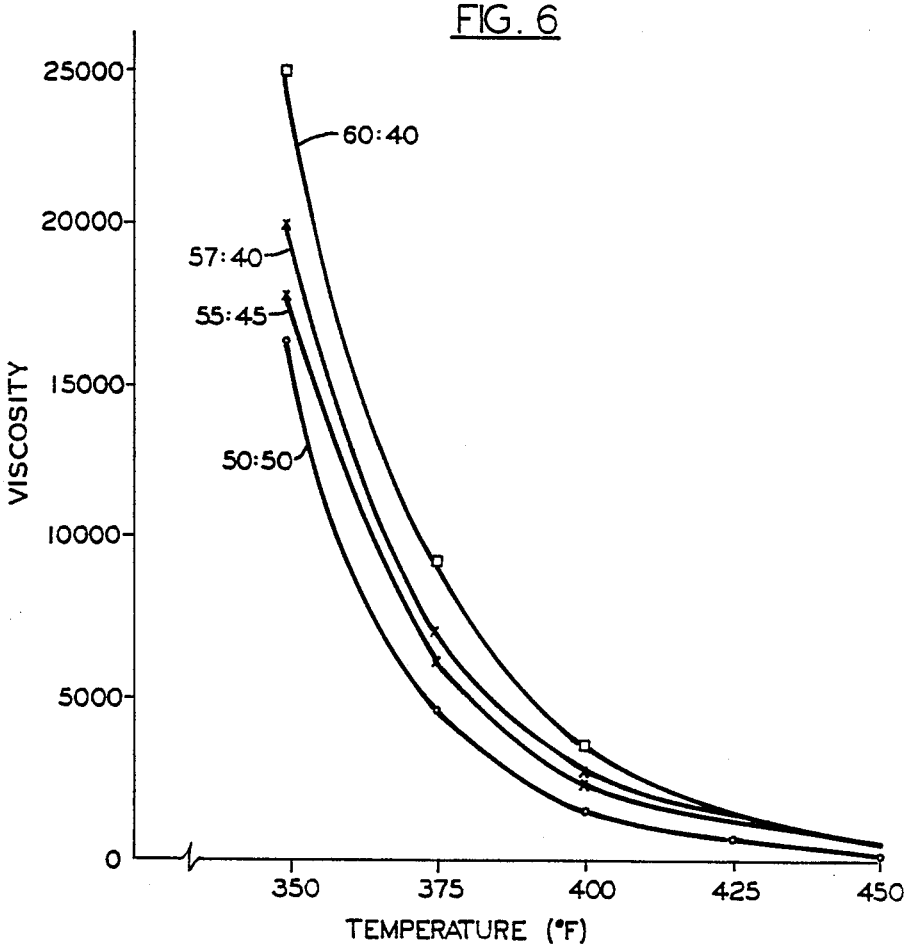
FIG. 5 shows typical viscosity versus temperature curves for various ratios of limestone to asphalt in the upper asphalt layer.

FIG. 5 shows the relationship between viscosity and temperature for various ratios of limestone fill to a typical asphalt (namely, 50:50, 55:45, 57:43 and 60:40) used in the preferred embodiments. The temperature range between about 325° F. and about 425° F. is useful for a number of composition ratios.

The finished material may be in the form of individual shingles, rolled roofing, modified bituminous roofing, or other waterproofing materials.

The use of a perforated polyester film, as described above, allows manufacture of a superior roofing product which has greater economy when compared with support materials of the prior art. The following comparison rates the characteristics of paper, fiberglass, polyester fiber and the polyester film of the present invention, both as roofing material characteristics, and in terms of the method of manufacture.

| | Paper | Glass | Fibers | Film |
|---|---|---|---|---|
| Line Speed | 2 | 1 | 3 | 1* |
| Shingle tear strength | 3 | 4 | 2 | 1 |
| On-line breaks | 3 | 2 | 2 | 1 |
| Adhesion | 2 | 2 | 1 | 2 |
| Elongation | 1 | 2 | 4 | 3 |
| Cold Temp. brittleness | 2 | 3 | 1 | 1 |
| Economics of Mat only | 1 | 3 | 4 | 2* |
| Economics of shingle | 3 | 2 | 4 | 1* |

-continued

| | Paper | Glass | Fibers | Film |
|---|---|---|---|---|
| | 18 | 18 | 21 | 12 |

1: Best performing; 4: Worst performing
*Estimated
Note
The above criteria are not weighted and in reality some items are more important than others.

The polyester fiber material is a very expensive material to use for the intermediate support layer and it has a tendency to elongate under even moderate stress on the coating line. Production is also at a slow speed and output relative to other materials. These factors tend to make the finished product very expensive, even though it is superior to other prior art materials. In comparison, the polyester film of the present invention has far superior characteristics providing a faster line speed during manufacture, reduced on-line breaks and elongation, lower production costs. In the comparison chart, the low total rating number for the intermediate layer film material of the present invention reflects these advantages over the prior art materials used in the manufacture of roofing materials.

Under conditions when an asphalt layer develops cracks, the polyester film layer of the present invention prevents the propagation of the crack into the other asphalt layer This characteristic may be due to the fact that in the present invention there is probably very little adhesion of the asphalt layers to the polyester film. This is because adhesion is not necessary since the layers are held together by the asphalt columns integrally interconnecting the two layers. But the lack of adhesion of the asphalt layers to the polyester film may allow some lateral movement of the film relative to the asphalt layers, when the shingle is under stress, thus preventing the propagation of cracks.

The invention also contemplates:

(a) a laminated material comprising a layer of plastic film having a plurality of spaced apart perforations therein, and a single layer of asphalt on one side of the plastic film, wherein the first layer of asphalt and the plastic film are intimately joined to one another by columns of the asphalt extending through the perforations in the plastic film with the ends of the columns flattened to form heads or flanges in effect riveting the asphalt to the film;

(b) a method of manufacturing a laminated material, comprising the steps of providing a length of plastic film having a plurality of perforations therein, applying extrudable asphalt to a surface of the plastic film, squeezing said plastic film, with the asphalt on surfaces thereof, so that the asphalt is extruded through the perforations in said plastic film and spreading on the surface of the film remote from the applied asphalt to form heads or flanges to intemately join the asphalt layer and the film together, and cooling said laminated material;

(c) extrusion to form the film, and forming the perforations, and/or the asphalt layer(s) as a part of the manufacturing process.

The foregoing description and illustrations should not be considered to limit the scope of the invention. Numerous modifications and changes will occur to those skilled in the art, and accordingly all suitable modifications and equivalence are considered to fall within the scope of the invention as defined by the claims which follows. While the laminated material the subject of this invention has been described in relation to waterproofing applications, it will be appreciated that it is suitable for other applications including as an air or vapor barrier.

We claim:

1. A laminated material comprising:
a layer of plastic film having a plurality of perforations spaced apart therein;
a first layer of asphalt on one side of said the plastic film; and
a second layer of asphalt on the other side thereof;
wherein said first and second layers of asphalt are integrally joined to one another through the perforations in the plastic film thereby resulting a unitary laminated structure.

2. A waterproofing material comprising;
a biaxially oriented polyester film having a plurality of perforations therein;
a first layer of asphalt on one side of said polyester film; and
a second layer of asphalt which is thicker than said first layer of asphalt and having embedded therein a weather resistant material amounting to a substantial portion of the composition of said second layer;
wherein a plurality of columns of asphalt extend through said perforations in said polyester film to interconnect and integrally joining the two layers of asphalt together, said columns of asphalt having a cross sectional area comprising a substantial portion of the lateral area of said waterproofing material.

3. A waterproofing material in accordance with claim 2, wherein said perforation are circular and have a diameter of about 0.04 to about 0.20 inches, the open area of said polyester film is about 20 to about 70% of the total surface area, and the thickness of said polyester film is about 0.003 inches to about 0.012 inches.

4. A waterproofing material in accordance with claim 2, wherein the shape of said perforations is one of oval, square, rectangular, triangular, pentagonal, trapezoidal, semi-circular and polyhedral with a minimal perforation cross dimension of about 0.04 to about 0.20 inches, the perforation open area amounts to about 20–70% of the area of the polyester film and the thickness of said polyester film is from 0.003 inches to about 0.012 inches.

5. A waterproofing material in accordance with claim 2, wherein the cross sectional area of the columns of asphalt extending through the polyester film amount to about 30–60% of the lateral area of the waterproofing material.

6. A waterproofing material in accordance with claim 2, wherein the perforations have a uniform pattern.

7. A waterproofing material in accordance with claim 2, wherein said polyester film has an interior unperforated area extending in at least one bilateral direction.

8. A waterproofing material in accordance with claim 2, wherein said polyester film has about a 0.25 to about a 0.0625 inches border along its outer edges which does not contain any perforation and said polyester film further includes an unperforated area in the interior of said polyester film extending in at least one biaxial direction across said polyester film.

9. A waterproofing material in accordance with claim 2, wherein said polyester film is made from polyethylene terephthalate.

10. A waterproofing material in accordance with claim 9, wherein said polyethylene terephthalate is recycled material having a stretch ratio of about 2.5 to about 5.0 in each biaxial direction and having a density range of over 1.35 g/cc to about 1.45 g/cc.

11. A waterproofing material in accordance with claim 2, wherein the stabilizer/filler material admixed therein amounts to about 40 to about 70% of the asphalt.

12. A waterproofing material according to claim 2, wherein the stabilizer/filler material admixed is limestone which amounts to about 40 to about 70% of the asphalt.

13. A waterproofing material according to claim 2, wherein the waterproofing material is finished into one of a shingle, a rolled waterproofing material and a modified bituminous waterproofing material.

14. A method of manufacturing a laminated material, comprising the steps of:
(a) unrolling a desired length of plastic film having a plurality of perforations therein;
(b) applying molten asphalt to both surfaces of the unrolled plastic film;
(c) squeezing said plastic film, with the molten asphalt on both surfaces thereof, so that the asphalt is forced through the perforations in said plastic film to integrally join both asphalt layers together; and
(d) cooling said laminated material.

15. A method of manufacturing waterproofing material, comprising the steps of:
(a) unrolling a continuous polyester film having a plurality of perforations therein;
(b) applying molten asphalt to both surfaces of the unrolled polyester film to form layers thereon;
(c) squeezing said polyester film, with the molten asphalt on both surfaces thereof, so that the asphalt is forced through the perforations in said polyester film to integrally join both asphalt layers together;
(d) depositing and impregnating a weather resistant material in at least one asphalt surface; and
(e) cooling said waterproofing material.

16. The method of claim 15, further comprising using circular perforations having a diameter of about 0.04 to about 0.20 inches, the open area of said polyester film amounting to about 20 to about 70% of the total surface area, and the thickness of said polyester film from about 0.003 inches to about 0.012 inches.

17. The method according to claim 15, further comprising using a mineral stabilizer filler which comprises at least 20% of the asphalt.

18. The method of claim 17, wherein said perforations have a typical perforation cross-dimension of about 0.04 to about 0.12 inches, the perforation open area amounting to about 20 to about 70% of the area of the polyester film and the thickness of said polyester film is from 0.003 inches to about 0.12 inches, the perforation size being chosen relative to the viscosity of the filled asphalt layers to facilitate the forcing of the filled asphalt through the perforations.

19. The method of claim 15, further comprising using an asphalt column cross sectional area amounting to about 30–60% of the lateral area of the waterproofing material.

20. The method of claim 15, further comprising using uniform perforation shape and spacing in all directions.

21. The method of claim 15, wherein said polyester film having a 0.25 to about a 0.0625 inch border along its outer edges which does not contain any perforation and said polyester film further includes an unperforated area in the interior of the polyester film extending in at least one biaxial direction across said film.

22. The method of claim 15, further comprising using, as the polyester, recycled polyethylene terephthalate having a stretch ratio of about 2.5 to about 5.0 in each biaxial direction and a density range of about 1.35 g/cc to about 1.45 g/cc.

23. The method of claim 17, further comprising applying the asphalt to the polyester film at a temperature of about 325° to about 425° F.

24. The method of claim 17, further comprising applying he mineral stabilizer filler to at least one asphalt layer comprising about 40 to about 70% of the asphalt.

25. The method according to claim 15, further comprising advancing the polyester film at a line speed of between 100 and 450 feet per minute.

26. A laminated material comprising:

a layer of plastic film having a plurality of spaced apart perforations therein; and a layer of asphalt on one side of said the plastic film;

wherein said layer of asphalt and said plastic film are joined to one another by columns of said asphalt extending through the perforations in the plastic film with the ends of the columns flattened to form column heads attaching the asphalt to the film.

27. A method of manufacturing a laminated material, comprising the steps of:

(a) providing a strip of plastic film having a plurality of perforations therein;

(b) applying extrudable asphalt to a surface of the plastic film;

(c) squeezing said plastic film, with the asphalt on surfaces thereof, so that the asphalt is extruded through the perforations in said plastic film and spreading the columns on the surface of the film remote from the applied asphalt to form heads to intimately join the asphalt layer and the film together; and (d) cooling said laminated material.

28. A method of manufacturing a laminated material, comprising the steps of:

(a) providing a strip of asphalt film having a plurality of perforations therein;

(b) providing a strip of asphalt on both surfaces of the plastic film;

(c) squeezing said plastic film, with the asphalt on both surfaces thereof, so that the asphalt is extruded through the perforations in said plastic film to integrally join both asphalt layers together; and (d) cooling said laminated material.

* * * * *